US009875714B2

(12) United States Patent
Lee et al.

(10) Patent No.: US 9,875,714 B2
(45) Date of Patent: Jan. 23, 2018

(54) DRIVING CIRCUIT ADJUSTING OUTPUT TIMING OF DATA DRIVING SIGNAL ACCORDING TO POSITIONS OF DATA LINES AND DISPLAY APPARATUS INCLUDING THE SAME

(71) Applicant: Samsung Display Co., LTD., Yongin, Gyeonggi-Do (KR)

(72) Inventors: Jae-Han Lee, Hwaseong-si (KR); Taegon Kim, Busan (KR); Sunkyu Son, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 252 days.

(21) Appl. No.: 14/806,971

(22) Filed: Jul. 23, 2015

(65) Prior Publication Data

US 2016/0125821 A1 May 5, 2016

(30) Foreign Application Priority Data

Nov. 3, 2014 (KR) ..... 10-2014-0151405

(51) Int. Cl.
*G09G 3/36* (2006.01)

(52) U.S. Cl.
CPC ... *G09G 3/3688* (2013.01); *G09G 2310/0221* (2013.01); *G09G 2310/08* (2013.01); *G09G 2320/0223* (2013.01); *G09G 2320/0233* (2013.01)

(58) Field of Classification Search
CPC ..... G11C 27/04
See application file for complete search history.

(56) References Cited

U.S. PATENT DOCUMENTS 5,033,067 A * 7/1991 Cole ..... H03K 5/131 327/269
6,542,139 B1 * 4/2003 Kanno ..... G09G 3/3677 345/87
8,054,278 B2 * 11/2011 Tanaka ..... G09G 3/3688 345/204

(Continued)

FOREIGN PATENT DOCUMENTS

KR 1020000056478 A 9/2000
KR 1020040009102 A 1/2004

(Continued)

*Primary Examiner* — Kent Chang
*Assistant Examiner* — Nathan Brittingham
(74) *Attorney, Agent, or Firm* — Cantor Colburn LLP

(57) ABSTRACT

A driving circuit includes a receiver configured to receive an image control signal comprising a data signal and a clock signal, separate the data signal from the clock signal and output the separated data and clock signals, a clock recovery unit generating a reference clock signal based on the clock signal and generating a plurality of multi-phase clock signals having different phases from that of the reference clock signal, an output clock generation unit outputting an output clock signal in synchronization with the clock signal and the plurality of multi-phase clock signals, and a data output unit driving a plurality of data lines with a data driving signal corresponding to the data signal in synchronization with the output clock signal, and the output clock generation unit outputs the plurality of multi-phase clock signals.

10 Claims, 14 Drawing Sheets

(56) References Cited

U.S. PATENT DOCUMENTS

2004/0061675 A1* 4/2004 Hirakawa ..... G09G 5/008 345/88
2007/0085798 A1* 4/2007 Hashimoto ..... G09G 3/3648 345/93
2007/0139339 A1* 6/2007 Kim ..... G09G 3/3648 345/98
2008/0192032 A1* 8/2008 Park ..... G09G 3/3677 345/204
2009/0135169 A1* 5/2009 Hiratsuka ..... G09G 3/3688 345/208
2009/0251454 A1* 10/2009 Jang ..... G09G 5/008 345/213
2010/0007648 A1* 1/2010 Nam ..... G09G 3/3611 345/213
2010/0039156 A1* 2/2010 Yamaguchi ..... G09G 3/2096 327/291
2011/0037758 A1* 2/2011 Lim ..... H03L 7/0805 345/213
2011/0148852 A1* 6/2011 Kim ..... G09G 3/20 345/213
2011/0158366 A1* 6/2011 Kim ..... H03L 1/00 375/371
2011/0181558 A1* 7/2011 Jeon ..... G09G 3/3611 345/204
2011/0242066 A1* 10/2011 Jeon ..... G09G 3/20 345/204
2011/0254814 A1* 10/2011 Ku ..... G06F 1/12 345/204
2011/0292024 A1* 12/2011 Baek ..... G09G 3/2096 345/212
2013/0113777 A1* 5/2013 Baek ..... G09G 3/20 345/212
2013/0321253 A1* 12/2013 Park ..... G09G 3/3611 345/100
2017/0098431 A1* 4/2017 Oh ..... G09G 5/12

FOREIGN PATENT DOCUMENTS

KR 1020080017598 A 2/2008
KR 1020080040905 A 5/2008
KR 1020110006969 A 1/2011

* cited by examiner

DRIVING CIRCUIT ADJUSTING OUTPUT TIMING OF DATA DRIVING SIGNAL ACCORDING TO POSITIONS OF DATA LINES AND DISPLAY APPARATUS INCLUDING THE SAME

This U.S. non-provisional patent application claims priority to Korean Patent Application No. 10-2014-0151405, filed on Nov. 3, 2014, and all the benefits accruing therefrom under 35 U.S.C. §119, the entire contents of which are hereby incorporated by reference.

BACKGROUND

1) Field

The invention relates to a driving circuit and a display device including the same.

2) Background

Typically, a display device includes a display panel for displaying an image and a driving circuit driving the display panel. The display panel includes a plurality of gate lines, a plurality of data lines, and a plurality of pixels. Each of the plurality of pixels includes a thin film transistor ("TFT"), a liquid crystal capacitor, and a storage capacitor. The driving circuit includes a data driver outputting data driving signals to the data lines and a gate driver outputting gate driving signals for driving the gate lines.

Such a display device may apply a gate on voltage to a gate electrode of a TFT desired to display and connected to the gate lines, and then apply a data voltage corresponding to a display image to a source electrode of the TFT to display the image. As the TFT is turned on, the data voltage applied to the liquid crystal capacitor and the storage capacitor is required to be maintained for a predetermined time after the TFT is turned off. However, as the size of the display panel becomes large and a high speed driving scheme is employed, a signal delay may occur on a delivery path of a gate signal output from the gate driver. In this case, since a charge rate of liquid crystal capacitors located near the gate driver gets lowered than a charge rate of the liquid crystal capacitors located distant from the gate driver, there occurs a phenomenon that display quality is not uniform within one display panel.

SUMMARY

The invention provides a driving circuit capable of improve display quality and a display device including the same.

Embodiments of the invention provide driving circuits including a receiver configured to receive an image control signal including a data signal and a clock signal, separate the data signal from the clock signal and output the data and clock signals separated from each other, a clock recovery unit generating a reference clock signal based on the clock signal and generating a plurality of multi-phase clock signals having different phases from that of the reference clock signal, an output clock generation unit outputting an output clock signal in synchronization with the clock signal and the plurality of multi-phase clock signals, and a data output unit driving a plurality of data lines with a data driving signal corresponding to the data signal in synchronization with the output clock signal. The plurality of data lines is sequentially arrayed in a first direction, and the output clock generation unit outputs the plurality of multi-phase clock signals and adjusts an output timing of the data driving signal according to positions of the plurality of data lines in the first direction.

In exemplary embodiments, the output clock generation unit may include a plurality of flip-flop arrays respectively receiving the clock signal and corresponding to each of the plurality of multi-phase clock signals, each of the plurality of flip-flop arrays may include a plurality of flip-flops sequentially connected to each other in serial. Each of the flip-flops may output an output clock signal in synchronization with a corresponding multi-phase clock signal among the plurality of multi-phase clock signals.

In other exemplary embodiments, the clock recovery unit may further generate a horizontal start signal, a horizontal clock signal and a load signal based on the clock signal.

In still other exemplary embodiments, the data output unit may include a shift register outputting a plurality of latch clock signals in synchronization with the horizontal start signal and the horizontal clock signal, a latch unit latching the data signal in response to the plurality of latch clock signals and outputting the latched data signal in response to the load signal, a digital-to-analog converter converting the latched data signal into the corresponding data driving signal, and an output buffer unit providing the data driving signal to the plurality of data lines in synchronization with the plurality of output clock signals.

In even other exemplary embodiments, the output buffer unit may include a plurality of buffers respectively corresponding to the plurality of data lines, and each of the plurality of buffers may provide the data driving signal to the corresponding data line in synchronization with a corresponding output clock signal among the plurality of output clock signals, In yet other exemplary embodiments, the plurality of buffers may be divided into a plurality of buffer groups, and buffers belonged to one buffer group may provide the data driving signal to the corresponding data line in synchronization with an identical output clock signal among the plurality of output clock signals.

In further embodiments, the clock recovery unit may include a phase locked loop, In other exemplary embodiments of the invention, display devices include a plurality of data lines extended in a first direction, a plurality of gate lines extended in a second direction, a plurality of pixels respectively connected to the plurality of gate lines and the plurality of data lines, a gate driver driving the plurality of gate lines, a source driver driving the plurality of data lines in response to the image control signal, and a timing controller providing the image control signal comprising a data signal and a clock signal to the source driver and controlling the gate driver. The source driver includes a receiver receiving the image control signal comprising the data signal and the clock signal, and separating the data signal from the clock signal to output the data and clock signals separated from each other, a clock recovery unit generating a reference clock signal based on the clock signal and generating a plurality of multi-phase clock signals having different phases from the reference clock signal, an output clock generation unit outputting an output clock signal in synchronization with the clock signal and the plurality of multi-phase clock signals; and a data output unit driving the plurality of data lines with a data driving signal corresponding to the data signal in synchronization with the output clock signal. The plurality of data lines are sequentially arrayed in a first direction, and the output clock generation unit outputs the plurality of multi-phase clock signals to allow an output timing of the data driving signal to be adjusted according to positions of the plurality of data lines in the first direction.

In exemplary embodiments, the output clock generation unit may include a plurality of flip-flop arrays respectively receiving the clock signal and corresponding to the plurality of multi-phase clock signals. Each of the plurality of flip-fop arrays may include a plurality of flip-flops sequentially connected to each other in series and each of the plurality of flip-flops may output an output clock signal in synchronization with a corresponding multi-phase clock signal among the plurality of multi-phase clock signals.

In other exemplary embodiments, the plurality of output clock signals may output from the plurality of flip-flops have different phases.

In other exemplary embodiments, the clock recovery unit may further generate a horizontal start signal, a horizontal clock signal and a load signal necessary for the data output unit based on the clock signal.

In other exemplary embodiments, the data output unit may include a shift register outputting a plurality of latch clock signals in synchronization with the clock signal and the horizontal clock signal, a latch unit latching the data signal in response to the plurality of latch clock signals and outputting the latched data signal in response to the load signal, a digital-to-analog converter converting the latched data signal into the corresponding data driving signal, and an output buffer unit providing the data driving signal to the plurality of data lines in synchronization with the plurality of output clock signals.

In other exemplary embodiments, the output buffer unit may include a plurality of buffers respectively corresponding to the plurality of data lines, and each of the plurality of buffers may provide the data driving signal to the corresponding data line in synchronization with a corresponding output clock signal among the plurality of output clock signals, In further exemplary embodiments, the plurality of buffers may be divided into a plurality of buffer groups, and buffers belonged to one buffer group may provide the data driving signal to a corresponding data line in synchronization with an identical output clock signal among the plurality of output clock signals.

In still further embodiments, the clock recovery unit may include a phase locked loop,

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain principles of the invention. In the drawings.

DETAILED DESCRIPTION

Figure 1:
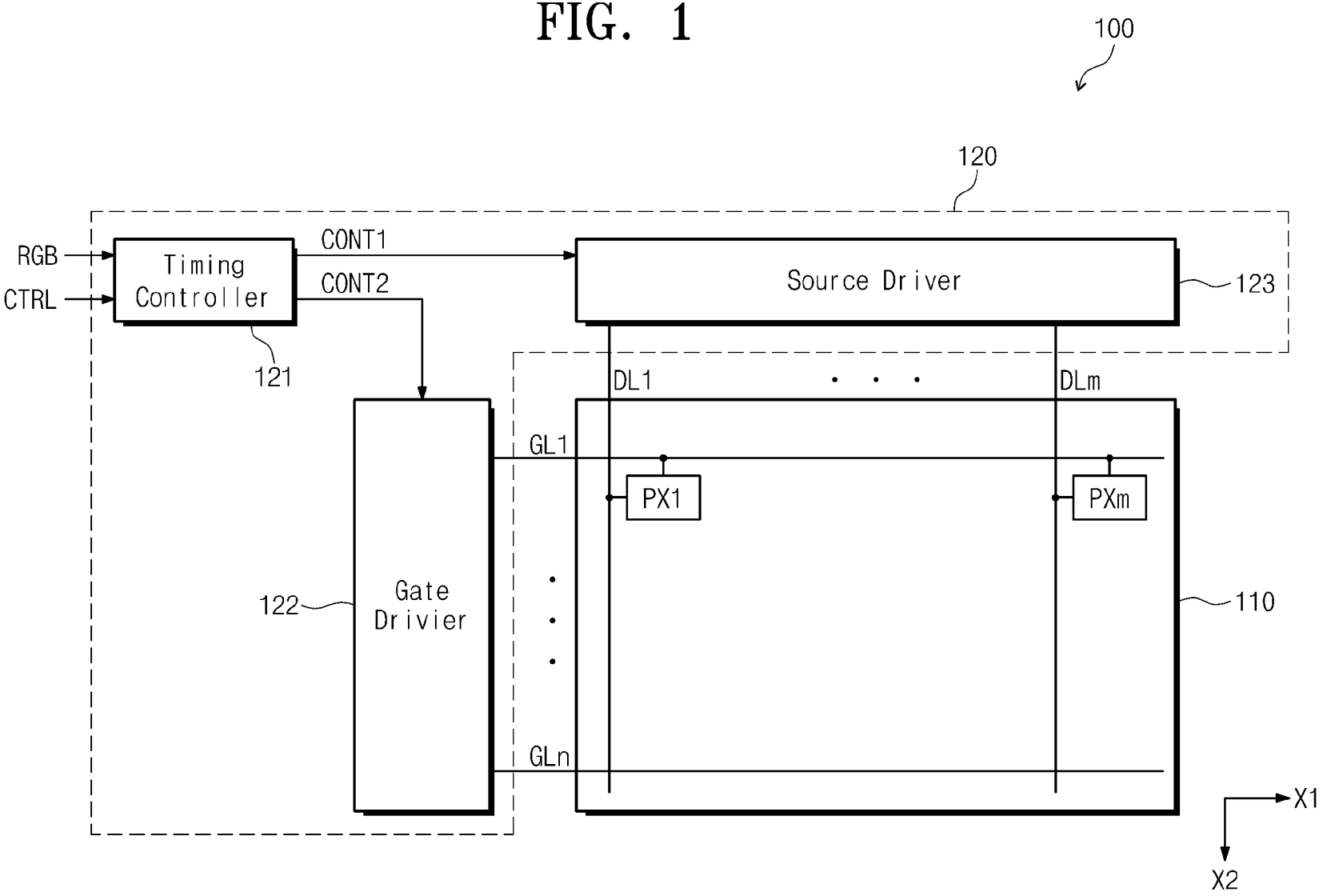
FIG. 1 is a block diagram illustrating an exemplary embodiment of a configuration of a display device according to the invention.

Exemplary embodiments of the invention will be described below in more detail with reference to the accompanying drawings. The invention may, however, be embodied in different forms and should not be construed as limited to the exemplary embodiments set forth herein. Rather, these embodiments are provided so that this invention will be thorough and complete, and will fully convey the scope of the invention to those skilled in the art.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the invention will be described in detail with reference to the accompanying drawings.

FIG. 1 is a block diagram illustrating a configuration of a display device according to an exemplary embodiment of the invention;

Referring to FIG. 1, a display device 100 includes a display panel 110 and a driving circuit 120. The driving circuit 120 includes a timing controller 121, a gate driver 122, and a source driver 123.

The display panel 110 includes a plurality of data lines DL1 to DLm, and a plurality of gate lines GL1 to GLn intersected with the plurality of data lines DL1 to DLm, and a plurality of pixels PX1 to PXm arrayed on the intersection regions thereof. The plurality of gate lines GL1 to GLn are extended in a first direction X1 from the gate driver 122 and sequentially arrayed in a second direction X2. The plurality of data lines DL1 to DLm are extended in the second direction X2 from the source driver 123 and sequentially arrayed in the first direction X1. The plurality of data lines DL1 to DLm and the plurality of gate lines GL1 to GLn are insulated from each other.

Even though not shown in the drawing, each of the plurality of pixels PX1 to PXm may include a switching transistor connected to a corresponding data line and a corresponding gate line, and a liquid crystal capacitor and a storage capacitor which are connected to the switching transistor.

The timing controller 121 receives an image signal RGB and a control signal CTRL provided from outside. The timing controller 121 provides an image control signal CONT1 to the source driver 123 and a gate control signal CONT2 to the gate driver 122. The timing controller 121 provides the image control signal CONT1 serialized in a clock embedded interface scheme to the source driver 123. In an exemplary embodiment, the image control signal CONT1 includes a data signal and a clock signal, for example. In an exemplary embodiment, the image control signal CONT1 may further include a polarity control signal and a load signal, for example.

The source driver 123 drives the plurality of data lines DL1 to DLm in response to the image control signal CONT1 from the timing controller 121. The source driver 123 may be implemented with an independent integrated circuit to be electrically connected to one side of the display panel 110 or to be directly mounted on the display panel 110. In an exemplary embodiment, the source driver 123 may be implemented with a single chip and include a plurality of chips. In the exemplary embodiment, the source driver 123 may change output timings of the data driving signals provided to the data lines DL1 to DLm.

The gate driver 122 drives the plurality of gate lines GL1 to GLn in response to the gate control signal CONT2 from the timing controller 121. In an exemplary embodiment, the gate driver 122 may be implemented with an independent integrated chip ("IC") to be electrically connected to one side of the display panel 110. In an exemplary embodiment, the gate driver 122 may include a circuit using an amorphous silicon gate ("ASG") using an amorphous silicon thin film transistor (a-Si TFT), an oxide semiconductor, a crystalline semiconductor, or a polycrystalline semiconductor to be integrated at a predetermined region on the display panel 110, for example. In another exemplary embodiment, the gate driver 122 may be implemented with a tape carrier package ("TCP") or a chip on film ("COF"), for example.

While a gate on voltage is applied to one gate line, respective switching transistors in a row of pixels connected to the one gate line may be turned on. At this point, the source driver 123 provides data driving signals corresponding to the data signals included in the image control signal CONT1 to the data lines DL1 to DLm. The data driving signals provided to the data lines DL1 to DLm are applied to corresponding pixels through the turned-on switching transistors. Here, a time period when a row of switching transistors are being turned on is referred to as 'one horizontal period' or '1H'.

Figure 2:
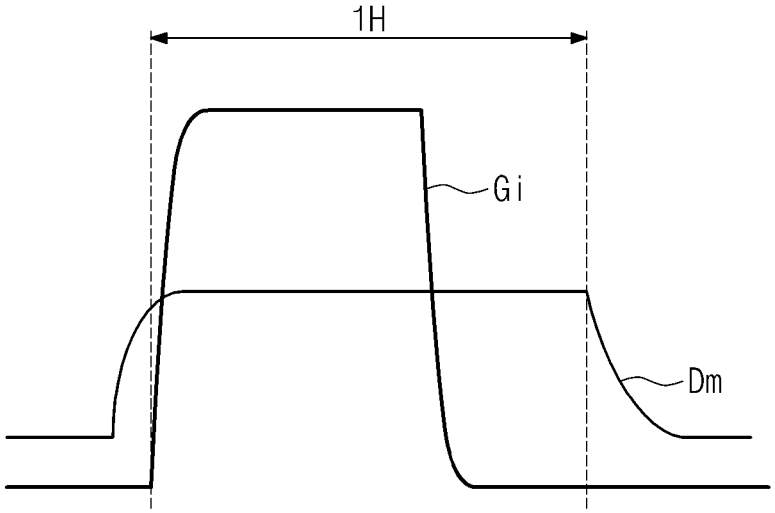
FIG. 2 is a view illustrating one example of a gate signal provided to any one of the gate lines and a data driving signal provided to a first data line illustrated in FIG. 1.

FIG. 2 is a view illustrating one exemplary embodiment of a gate signal provided to any one of the gate lines and a data driving signal provided to a first data line illustrated in FIG. 1. In other words, FIG. 2 shows a relationship between the data driving signal provided to the data line adjacent to the gate driver, and the gate signal.

Figure 3:
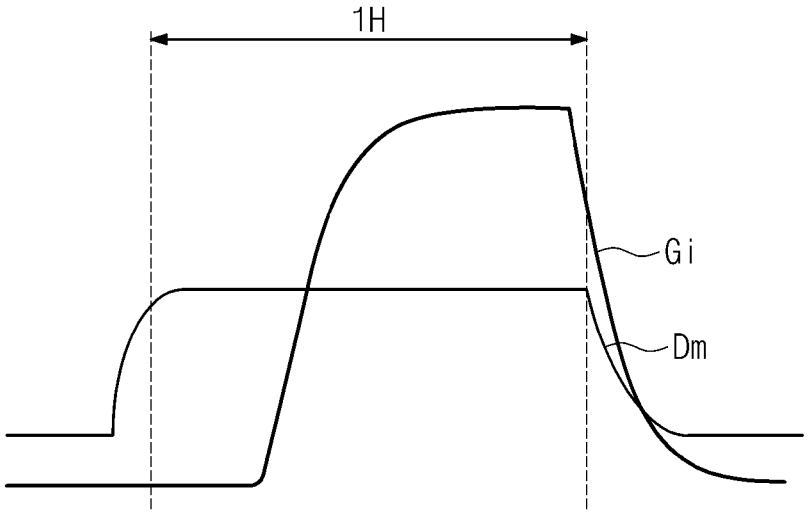
FIG. 3 is a view illustrating one example of a gate signal provided to any one of the gate lines and a data driving signal provided to a last data line illustrated in FIG. 1.

FIG. 3 is a view showing one exemplary embodiment of a gate signal provided to any one of the gate lines and a data driving signal provided to the last data line illustrated in FIG. 1. In other words, FIG. 3 shows a relationship between the data driving signal provided to the data lines distant from the gate driver, and the gate signal.

Referring to FIGS. 1, 2 and 3, i-th gate signal Gi generated from the gate driver 122 is transmitted through i-th gate line GLi. A first pixel PX1 is connected to a gate line GLi and a data line DL1 and a second pixel PXm is connected to the gate line GLi and a data line DLm.

It may be seen that the gate signal Gi output from the gate driver 122 is delayed by a predetermined time when provided to the pixel PXm farther from the gate driver 122 in a first direction X1 than when provided to the pixel PX1.

Even though the source driver 123 provides the data driving signal D1 to Dm at the same timing, namely, simultaneously to the data lines DL1 to DLm, a charge rate of the second pixel PXm, which is farther from the gate driver 122 in the first direction X1 becomes lowered due to the delay of the gate signal Gi than that of the first pixel PX1 adjacent to the gate driver 122.

Figure 4:
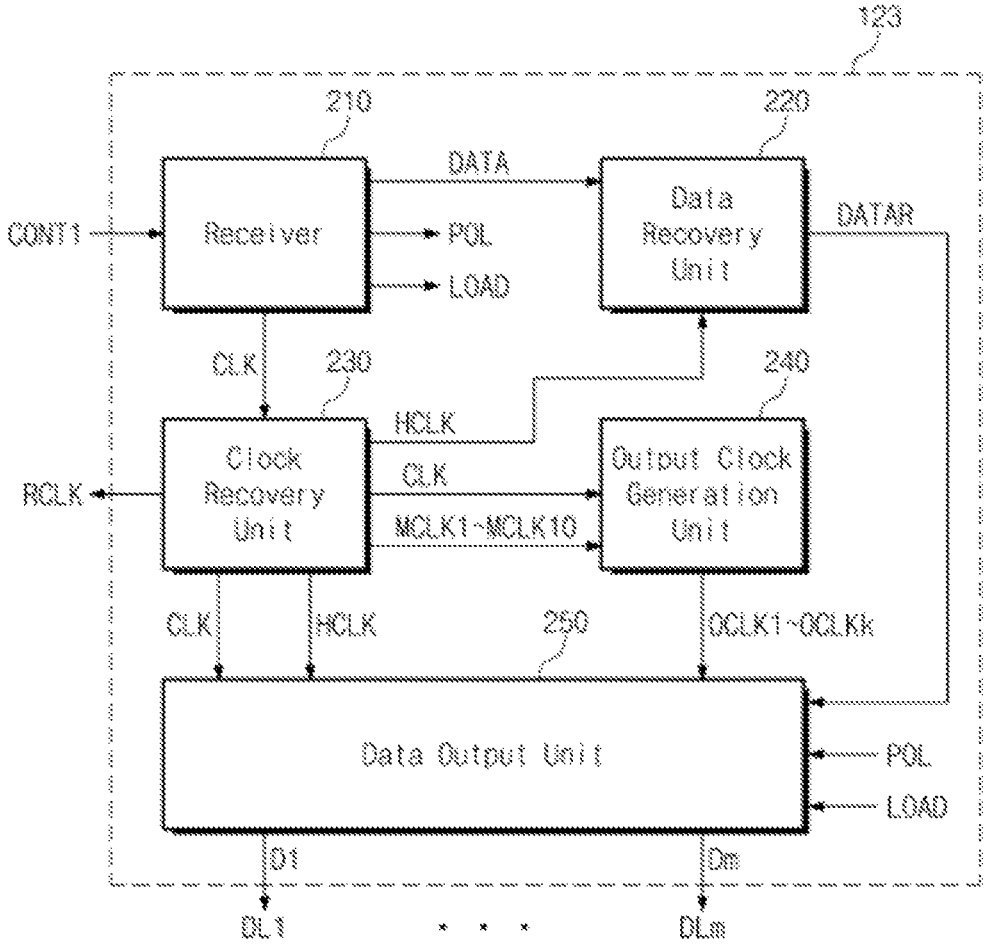
FIG. 4 is a block diagram illustrating an exemplary configuration of a source driver illustrated in FIG. 1.

FIG. 4 is a block diagram illustrating an exemplary configuration of a source driver illustrated in FIG. 1.

Referring to FIG. 4, the source driver 123 includes a receiver 210, a data recovery unit 220, a clock recovery unit 230, an output clock generation unit 240 and a data output unit 250.

The receiver 210 receives the image control signal CONT1 from the timing controller 121 (shown in FIG. 1), separates the image control signal CONT1 to a data signal DATA, a clock signal CLK, a polarity control signal POL and a load signal LOAD, and outputs the signals separated from each other. The data signal DATA is provided to the data recovery unit 220, the clock signal CLK is provided to the clock recovery unit 230, the polarity control signal POL and the load signal LOAD are provided to the data output unit 250.

The clock recovery unit 230 outputs the horizontal clock signal HCLK and the plurality of multi-phase clock signals MCLK1 to MCLK10 in synchronization with the clock signal CLK. The plurality of multi-phase clock signals MCLK1 to MCLK10 respectively has phases different from each other during one period of the reference clock signal RCLK. The clock recovery unit 230 provides the clock signal CLK and the plurality of multi-phases clock signals MCLK1 to MCLK10 to the output clock generation unit 240. As shown in FIG. 4, the clock recovery unit 230 may further generate the reference clock signal RCLK. The clock recovery unit 230 may be implemented with a phase locked loop PLL.

The data recovery unit 220 recovers the data signal DATA in synchronization with the horizontal clock signal HCLK and outputs a recovery data signal DATAR. In an exemplary embodiment, the data recovery unit 220 may convert the data signal DATA, which is a serial signal, into the recovery data signal DATAR corresponding respectively to the pixels PX1 to PMm, for example.

The output clock generation unit 240 outputs a plurality of output clock signals OCLK1 to OCLKk in synchronization with the clock signal CLK and the plurality of multi-phase clock signals MCLK1 to MCLK10.

The data output unit 250 drives the plurality of data lines DL1 to DLm with the data driving signals D1 to Dm corresponding to the recovery data signal from the data recovery unit 220 in response to the horizontal clock signal from the clock recovery unit 230, the plurality of output clock signals OCLK1 to OCLKk from the output clock generation unit 240, and the polarity control signal POL and the load signal LOAD from the receiver 210.

Figure 5:
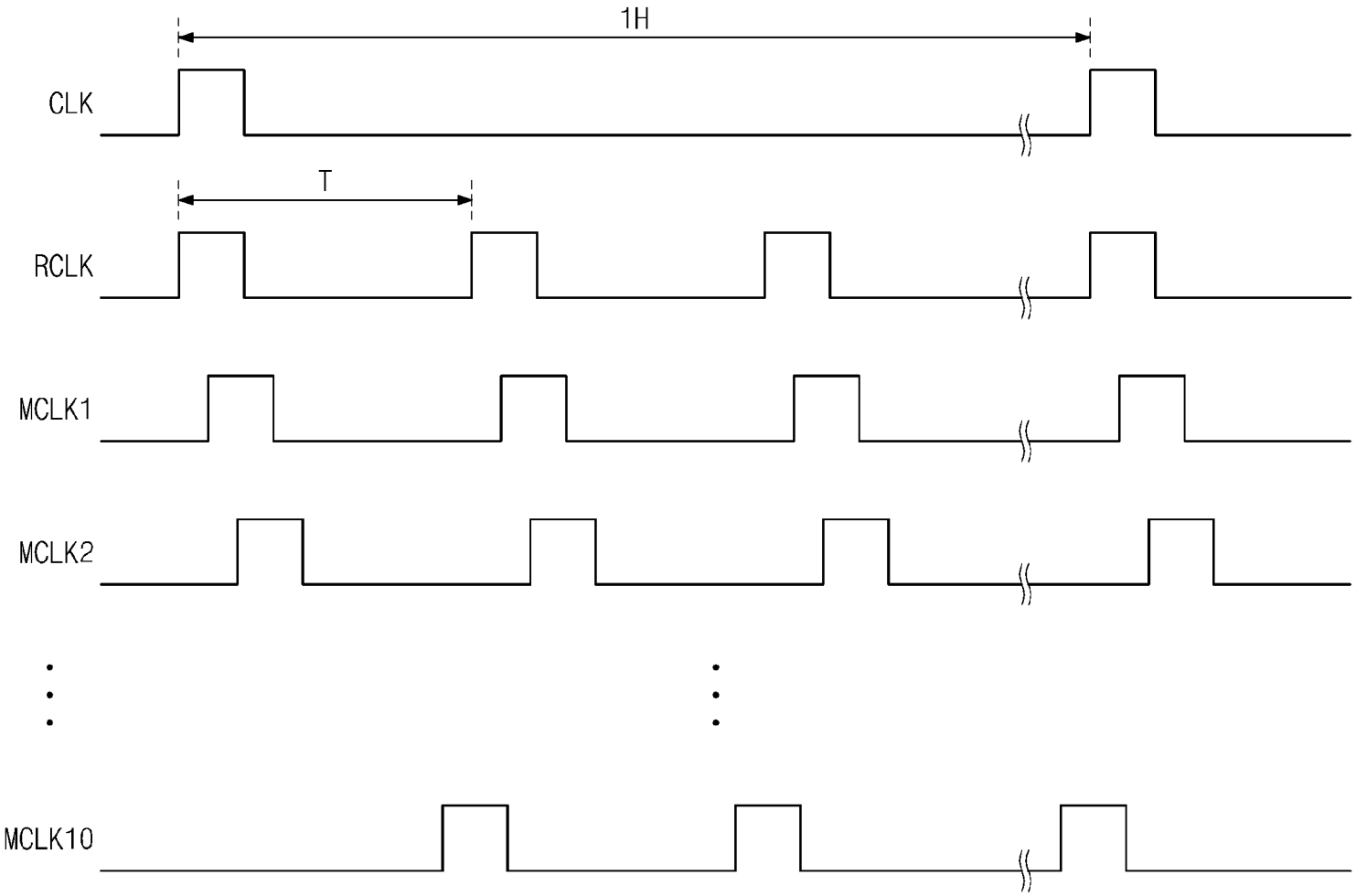
FIG. 5 is a timing diagram illustrating a relationship between a reference clock signal and a plurality of multi-phase clock signals output from a clock recovery unit illustrated in FIG. 4.

FIG. 5 is a timing diagram illustrating a relationship between a reference clock signal and the plurality of multi-phase clock signals output from the clock recovery unit illustrated in FIG. 4.

Referring to FIG. 5, the period of the clock signal CLK is one horizontal period 1H. The reference clock period RCLK includes a plurality of pulses during one horizontal period 1H. The plurality of multi-phase clock signals MCLK1 to MCLK10 respectively have different phases from each other during one period T of the reference clock signal RCLK.

Figure 6:
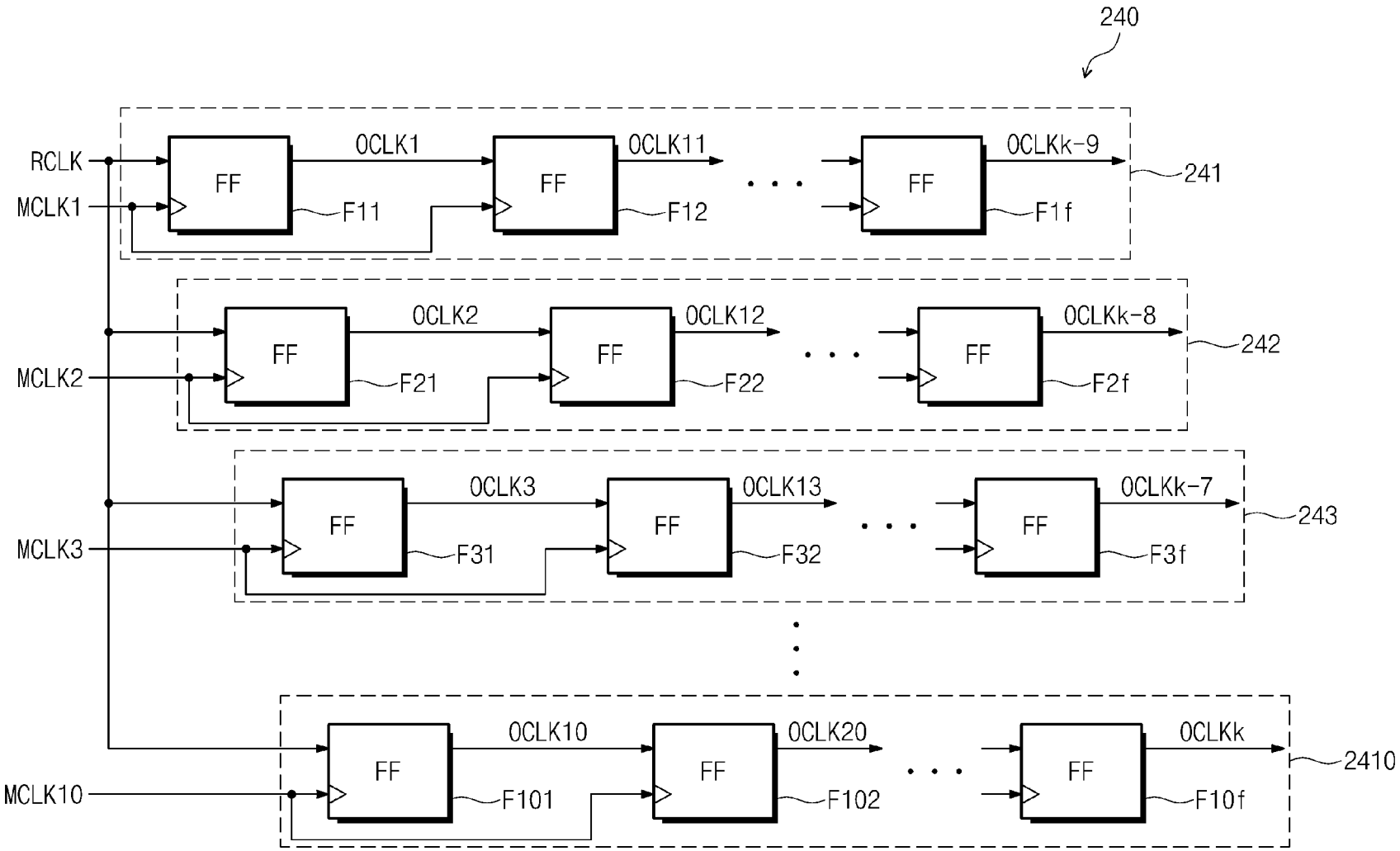
FIG. 6 is a view exemplarily illustrating a configuration of an output clock generation unit illustrated in FIG. 4.

FIG. 6 is a view exemplarily illustrating a configuration of the output clock generation unit illustrated in FIG. 4.

Referring to FIG. 6, the output clock generation unit 240 includes a plurality of flip-flop arrays 241 to 2410. The plurality of flip-flop arrays 241 to 2410 respectively correspond to the plurality of multi-phase clock signals MCLK1 to MCLK10 and receive the clock signal CLK.

Each of the plurality of flip-flop arrays 241 to 2410 includes a plurality of flip-flops. In other words, the flip-flop array 241 includes flip-flops F11 to F1*f* connected serially to each other. The flip-flops F11 to F1*f* deliver the clock signal CLK to an output in synchronization with the corresponding multi-phase clock signal MCLK1. The outputs of the flip-flops F11 to F1*f* are the output clock signals OCLK1 to OCLKk−9.

The flip-flop array 242 includes flip-flops F21 to F2*f* connected serially. The flip-flops F21 to F2*f* deliver the clock signal CLK to an output in synchronization with the corresponding multi-phase clock signal MCLK2. The outputs of the flip-flops F21 to F2*f* are the output clock signals OCLK2 to OCLKk−8.

The flip-flop array 243 includes flip-flops F31 to F3*f* connected serially. The flip-flops F31 to F3*f* deliver the clock signal CLK to an output in synchronization with the corresponding multi-phase clock signal MCLK3. The outputs of the flip-flops F31 to F3*f* are the output clock signals OCLK3 to OCLKk−7.

The flip-flop array 2410 includes flip-flops F101 to F10*f* connected serially. The flip-flops F101 to F10*f* deliver the clock signal CLK to an output in synchronization with the corresponding multi-phase clock signal MCLK10. The outputs of the flip-flops F101 to F10*f* are the output clock signals OCLK10 to OCLKk.

When waveforms of the clock signal CLK and the multi-phase clock signals MCLK1 to MCLK10 are the same as those illustrated in FIG. 5, the output clock signals OCLK1 to OCLKk are signals having different phases during one horizontal period 1H.

Figure 7:
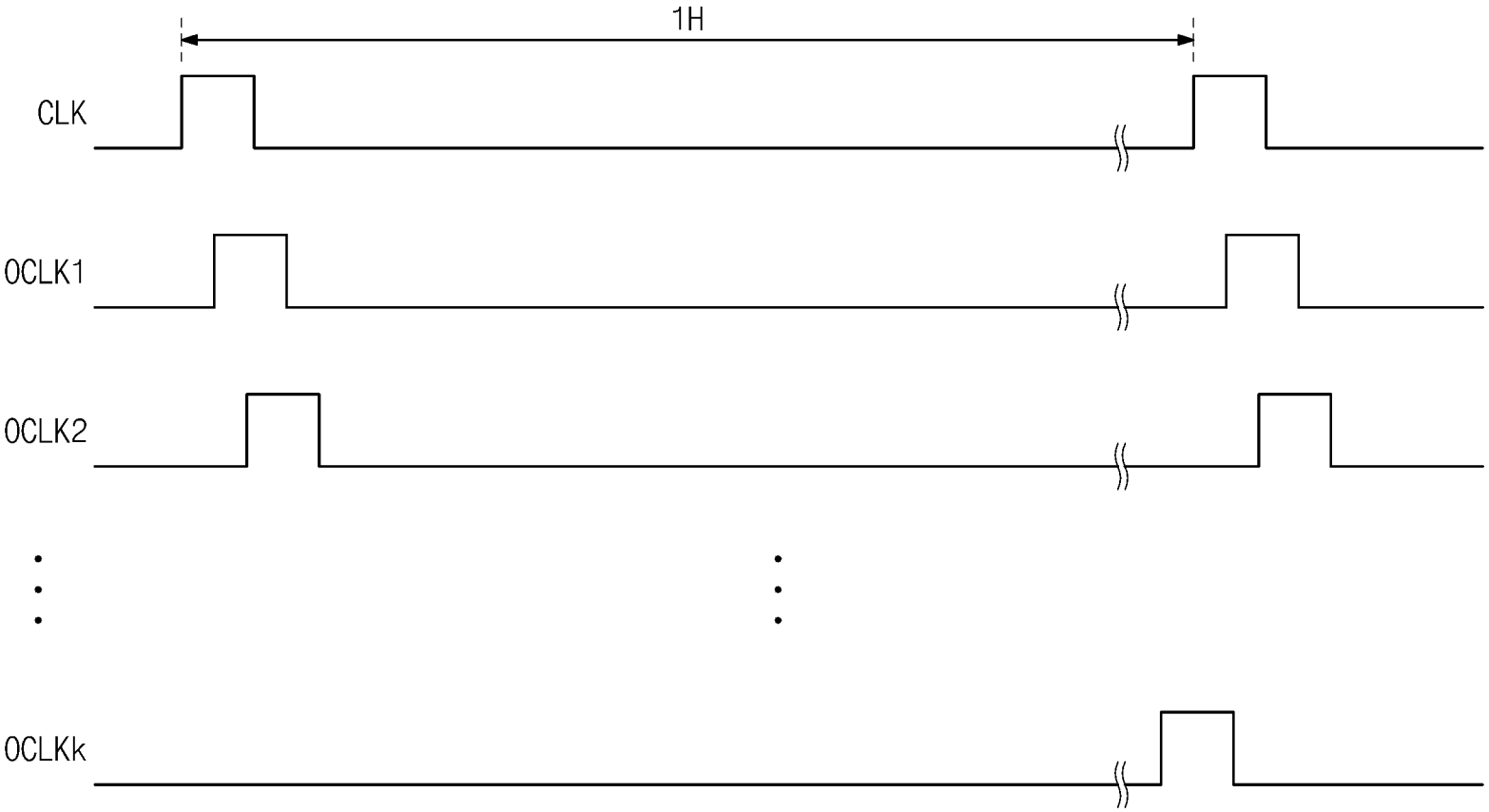
FIG. 7 is a timing diagram illustrating one example of output clock signals output from the output clock generation unit illustrated in FIG. 6.

FIG. 7 is a timing diagram illustrating one example of output clock signals output from the output clock generation unit illustrated in FIG. 6.

Referring to FIG. 7, the output clock signals OCLK1 to OCLKk are signals delayed by different delay times during the one horizontal period 1H.

Figure 8:
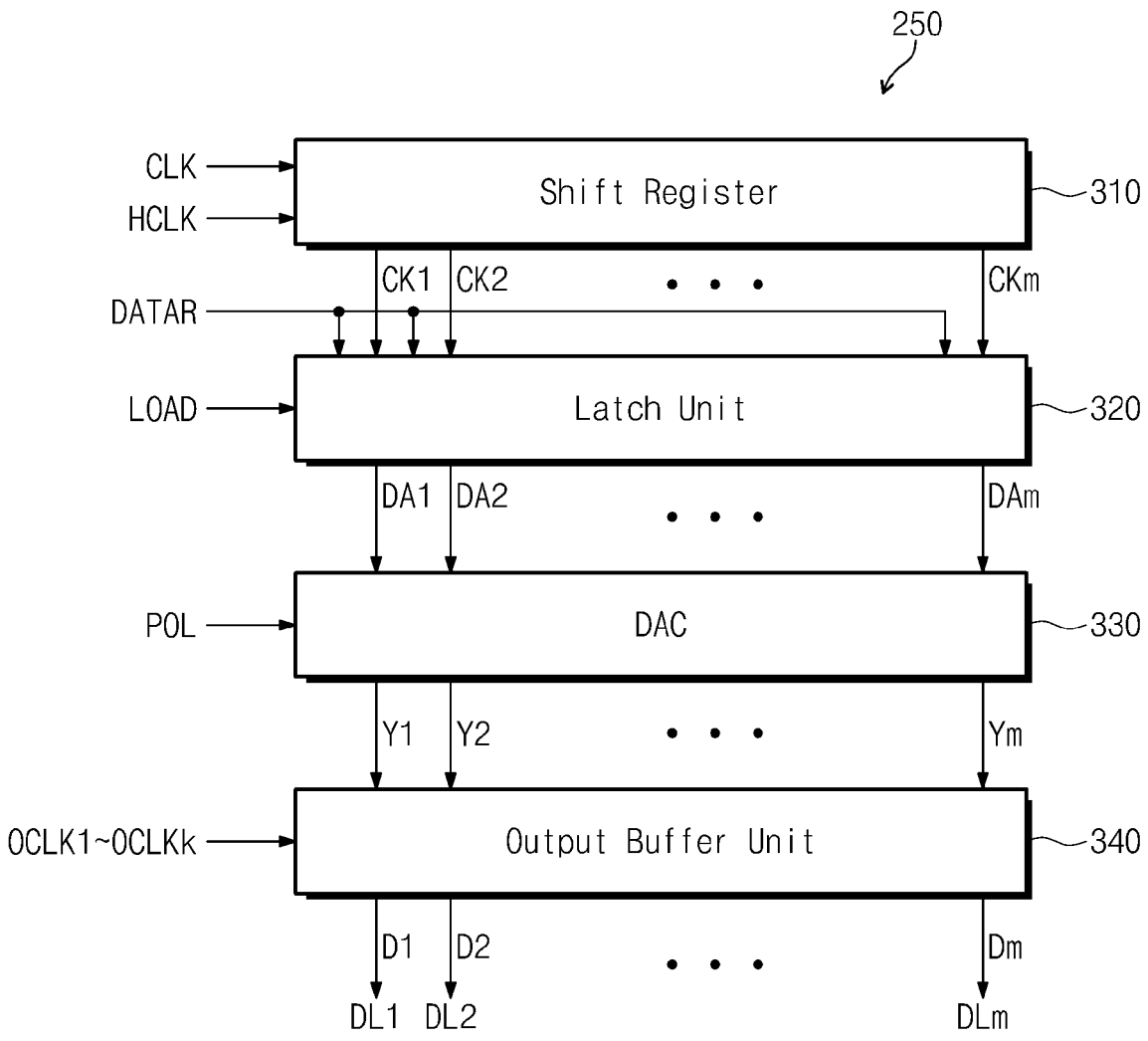
FIG. 8 is a block diagram illustrating a configuration of a data output unit illustrated in FIG. 4.

FIG. 8 is a block diagram illustrating a configuration of the data output unit illustrated in FIG. 4.

Referring to FIG. 8, the data output unit 250 includes a shift register 310, a latch unit 320, a digital-to-analog converter 330, and an output buffer unit 340.

The shift register 310 shifts the clock signal CLK in synchronization with the horizontal clock signal HCLK. The shift register 310 outputs a plurality of latch clock signals CK1 to CKm. The plurality of latch clock signals CK1 to CKm may be sequentially activated. The latch unit 320 sequentially latches the recovery data signal DATAR in synchronization with the latch clock signals CK1 to CKm from the shift register 310, and simultaneously provides the latch data signals DA1 to DAm to the digital-to-analog converter 330 in response to the load signal LOAD.

The digital-to-analog converter ("DAC") 330 outputs, to the output buffer unit 340, gradation voltages Y1 to Ym corresponding to latch data signals DA to DAm from the latch unit 320 in response to the polarity control signal POL provided from the receiver 210 illustrated in FIG. 4. The output buffer 340 outputs the data driving signals D1 to Dm to the data lines DL1 to DLm using the gradation voltages Y1 to Ym received from the digital-to-analog converter 330, in response to the output clock signals OCLK1 to OCLKk.

Figure 9:
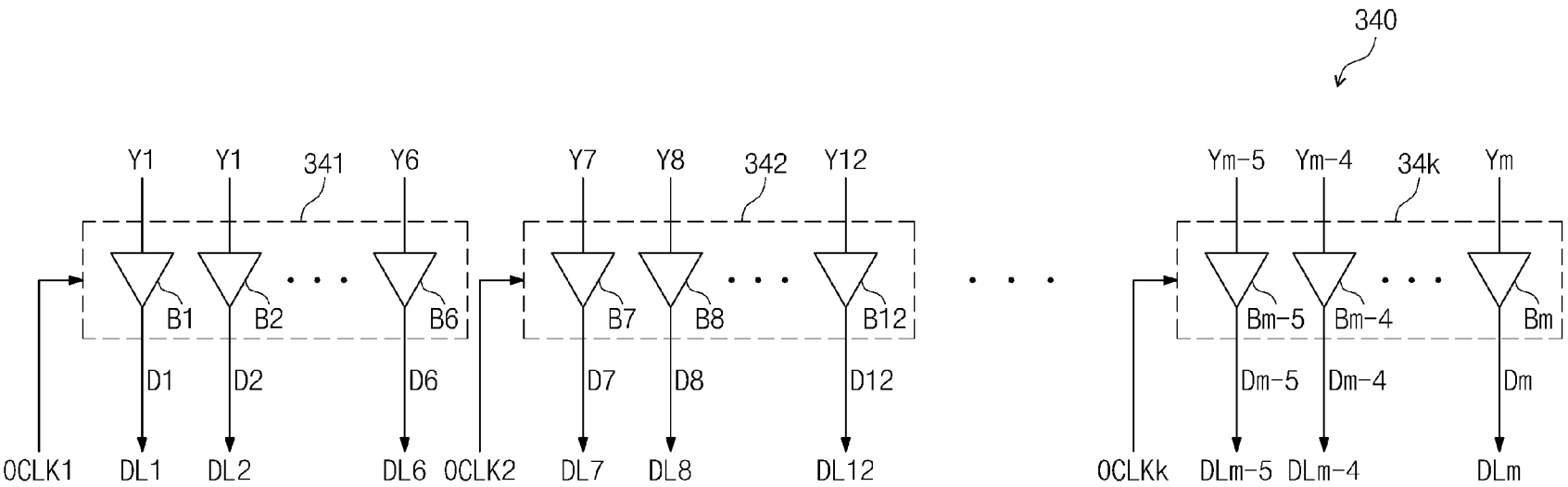
FIG. 9 is a view illustrating a configuration of an output buffer unit illustrated in FIG. 8.

FIG. 9 is a view illustrating a configuration of an output buffer unit illustrated in FIG. 8.

Referring to FIG. 9, the output buffer unit 340 includes a plurality of buffer groups 341 to 34*k*. The plurality of buffer groups 341 to 34*k* respectively correspond to the output clock signals OCLK1 to OCLKk.

In an exemplary embodiment, each of the plurality of buffer groups 341 to 34*k* includes 6 buffers, for example. In other words, the buffer group 341 includes buffers B1 to B6, the buffer group 342 includes buffers B7 to B12, and the buffer group 34*k* includes buffers Bm−5 to Bm. The buffers B1 to Bm respectively correspond to the data lines DL1 to DLm. In the exemplary embodiment, when each of the plurality of buffer groups 31 to 34*k* includes 6 buffers, k is the number of data lines divided by six, namely, m/6.

As described above in relation to FIG. 7, the output clock signals OCLK1 to OCLKk are signals delayed by different delay times during the one horizontal period 1H. Therefore, the plurality of buffer groups 341 to 34*k* sequentially output the data driving signals D1 to Dm in synchronization with the output clock signals OCLk1 to OCLKk. In an exemplary embodiment, the buffer group 341 outputs the data driving signals D1 to D6, and, after a predetermined time passes, the buffer group 34*k* outputs the data driving signals Dm−5 to Dm.

In the exemplary embodiment, each of the plurality of buffer groups 341 to 34*k* includes 6 buffers, but the number of buffers belonged to each of the plurality of buffer groups 341 to 34*k* may be any number greater than one. According to the number of buffers belonged to each of the plurality of buffer groups 341 to 34*k*, the number of the output clock signals OCLK1 to OCLKk and the number of the multi-phase clock signals MCLK1 to MCLK10 may be changed.

Figure 10:
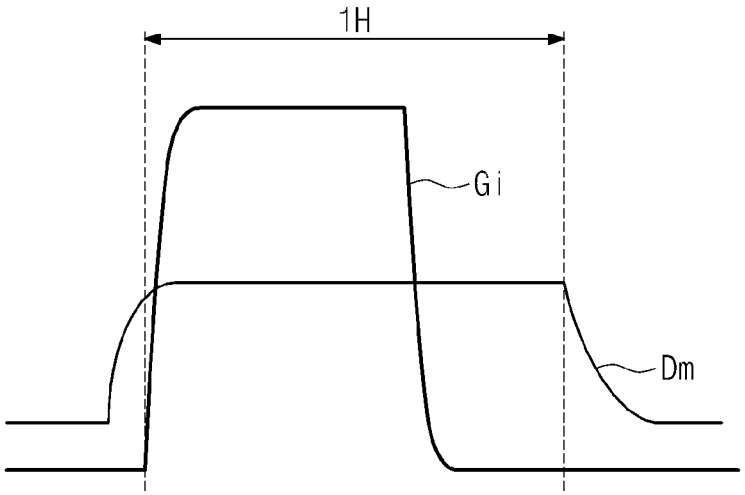
FIG. 10 is a view showing one example of a gate signal provided to any one of the gate lines and a data driving signal provided to the first data line illustrated in FIG. 1.

FIG. 10 is a view illustrating one example of a gate signal provided to any one of the gate lines and a data driving signal provided to the first data line illustrated in FIG. 1. In other word, FIG. 10 illustrates a relationship between the data driving signal provided to the data line adjacent to the gate driver, and the gate signal.

Figure 11:
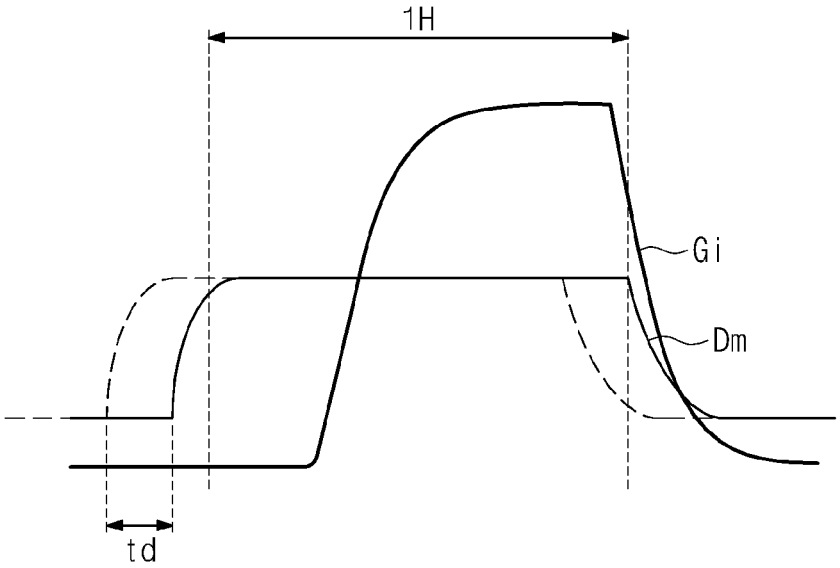
FIG. 11 is a view illustrating one example of a gate signal provided to any one of the gate lines and a data driving signal provided to the last data line illustrated in FIG. 1.

FIG. 11 is a view illustrating one example of a gate signal provided to any one of the gate lines and a data driving signal provided to the last data line illustrated in FIG. 1. In other words, FIG. 11 illustrates a relationship between the data driving signal provided to the data line distant from the gate driver, and the gate signal.

Referring to FIGS. 1, 9, 10, and 11, the output buffer unit 340 in the source driver 123 drives data lines DL11 to DLm in response to the output clock signals OCLK1 to OCLKk. In an exemplary embodiment, an output timing of the data driving signal Dm provided to the second pixel PXm is delayed by a predetermined time td than an output timing of the data driving signal D1 provided to the first pixel PX1.

The gate signal Gi output from the gate driver 122 is delayed by a predetermined time when provided to the pixel PXm farther from the gate driver 122 in the first direction X1 than when provided to the pixel PX1.

A charge time of the second pixel PXm may be secured by delaying an output timing of the data driving signal Dm by the delay time of the gate signal Gi. In an exemplary embodiment, the output delay time td of the data driving signal Dm may be set by considering the delay time of the gate signal Gi transmitted through the gate line GLi.

In such a way, the delay of the gate signal Gi transmitted to the gate line GLi may be compensated by providing, to the second pixel PXm, the data driving signal DM delayed by the delay time td than providing the data driving signal D1 to the first pixel PX1.

Figure 12:
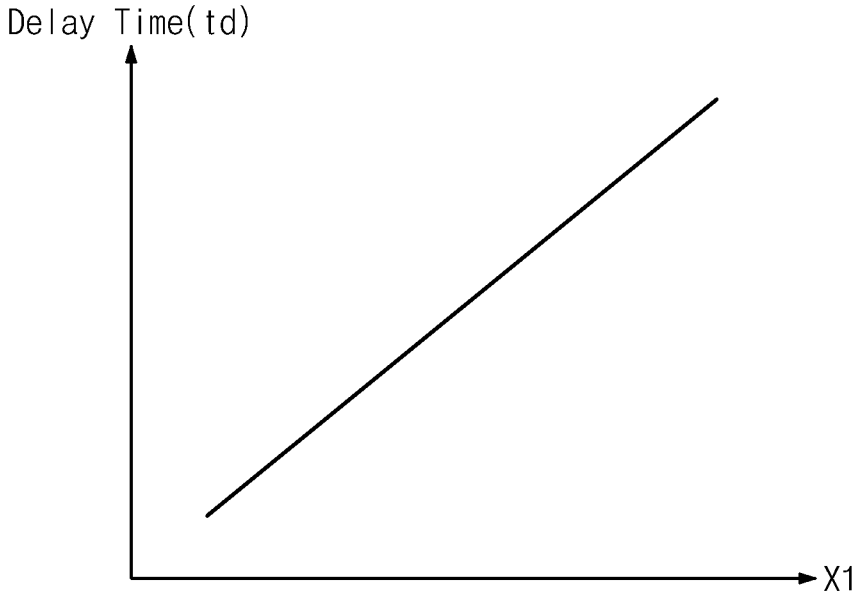
FIG. 12 is a graph exemplarily illustrating a delay time of data driving signal according to positions of data lines.

FIG. 12 is a graph exemplarily illustrating a delay time of a driving signal according to positions of data lines.

Referring to FIGS. 1 and 12, when the gate driver 122 is disposed at the left side of the display panel 110, the time delay td of the data driving signal provided to a data line farther from the gate driver 122 in the first direction X1 becomes longer.

Figure 13:
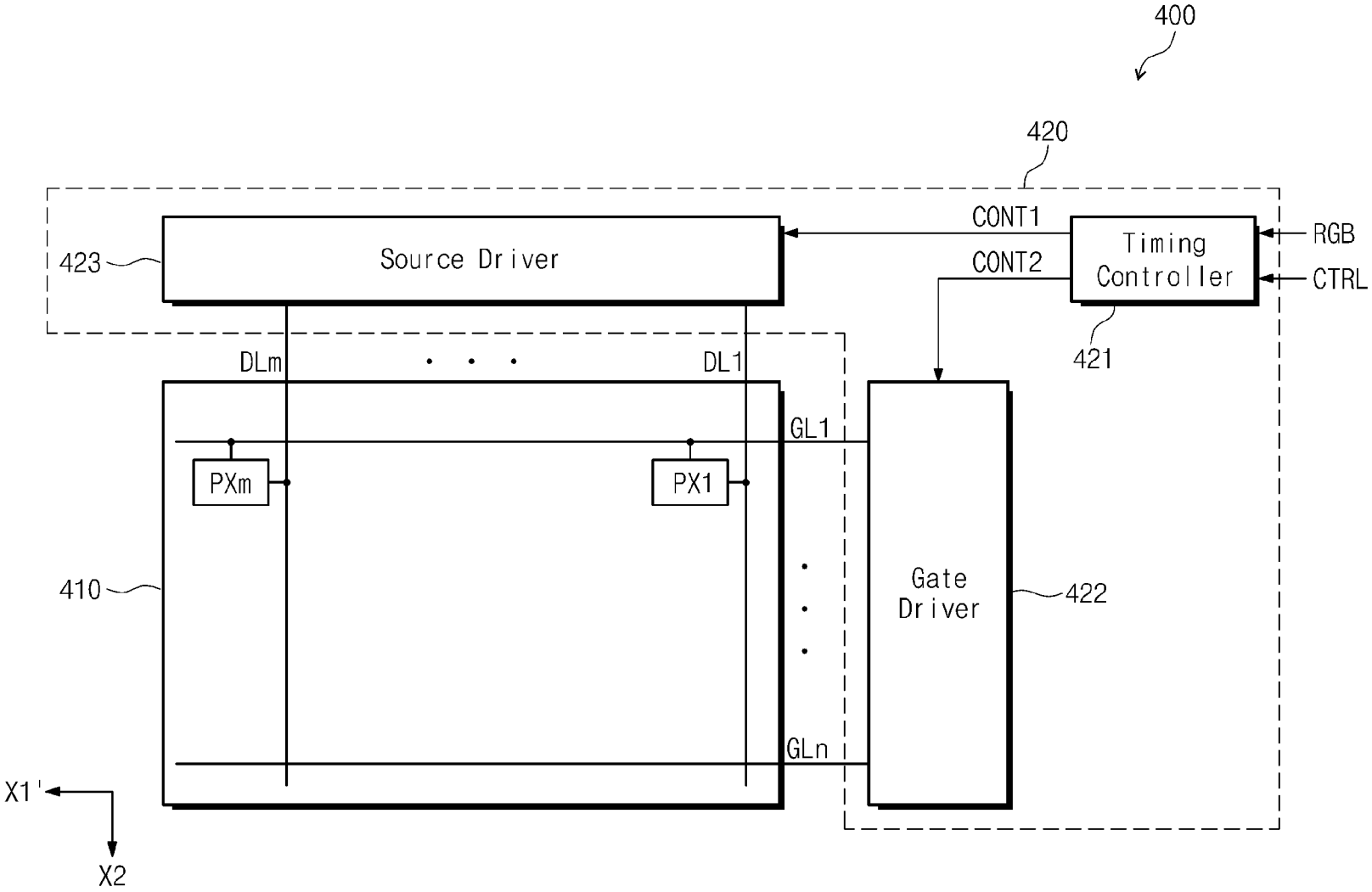
FIG. 13 is a block diagram illustrating another exemplary embodiment of a configuration of a display device according to the invention.

FIG. 13 is a block diagram illustrating a configuration of a display device according to another exemplary embodiment of the invention.

Referring to FIG. 13, a display device 400 includes a display panel 410 and a driving circuit 420. The driving circuit 420 includes a timing controller 421, a gate driver 422, and a source driver 423. The display device 400 illustrated in FIG. 13 has a similar configuration to the display device 100 illustrated in FIG. 1 and accordingly overlapping description will be omitted. Unlike the gate driver 122 of the display device 100 illustrated in FIG. 1, the gate driver 422 of the display device 400 is disposed at the right side of the display panel 410.

Figure 14:
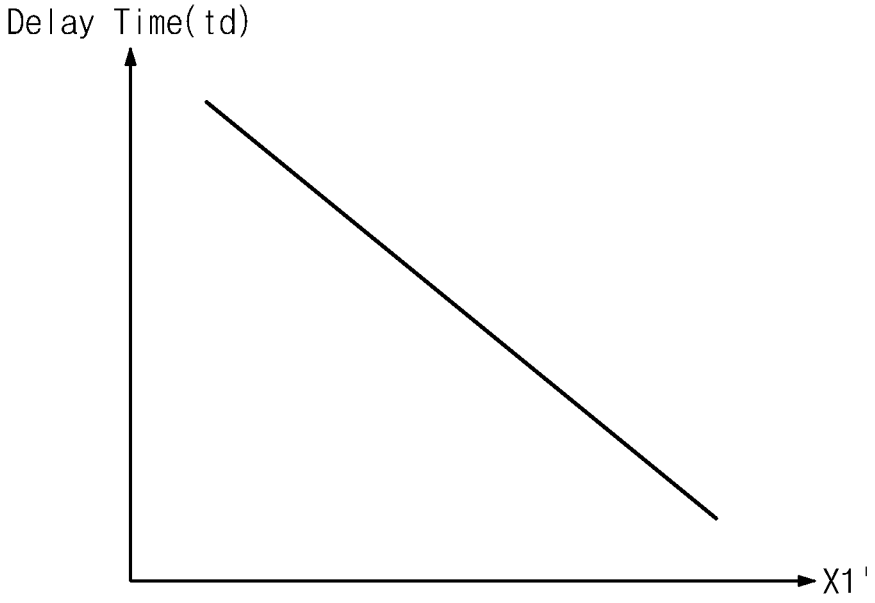
FIG. 14 is a graph exemplarily illustrating a delay time of a data driving signal according to positions of data lines illustrated in FIG. 13.

FIG. 14 is a graph exemplarily illustrating a delay time of a driving signal according to positions of data lines illustrated in FIG. 13.

Referring to FIGS. 13 and 14, when the gate driver 422 is disposed at the right side of the display panel 410, the time delay td of the data driving signal provided to a data line becomes longer, as the data line is farther in a third direction X1' from the gate driver 422.

Figure 15:
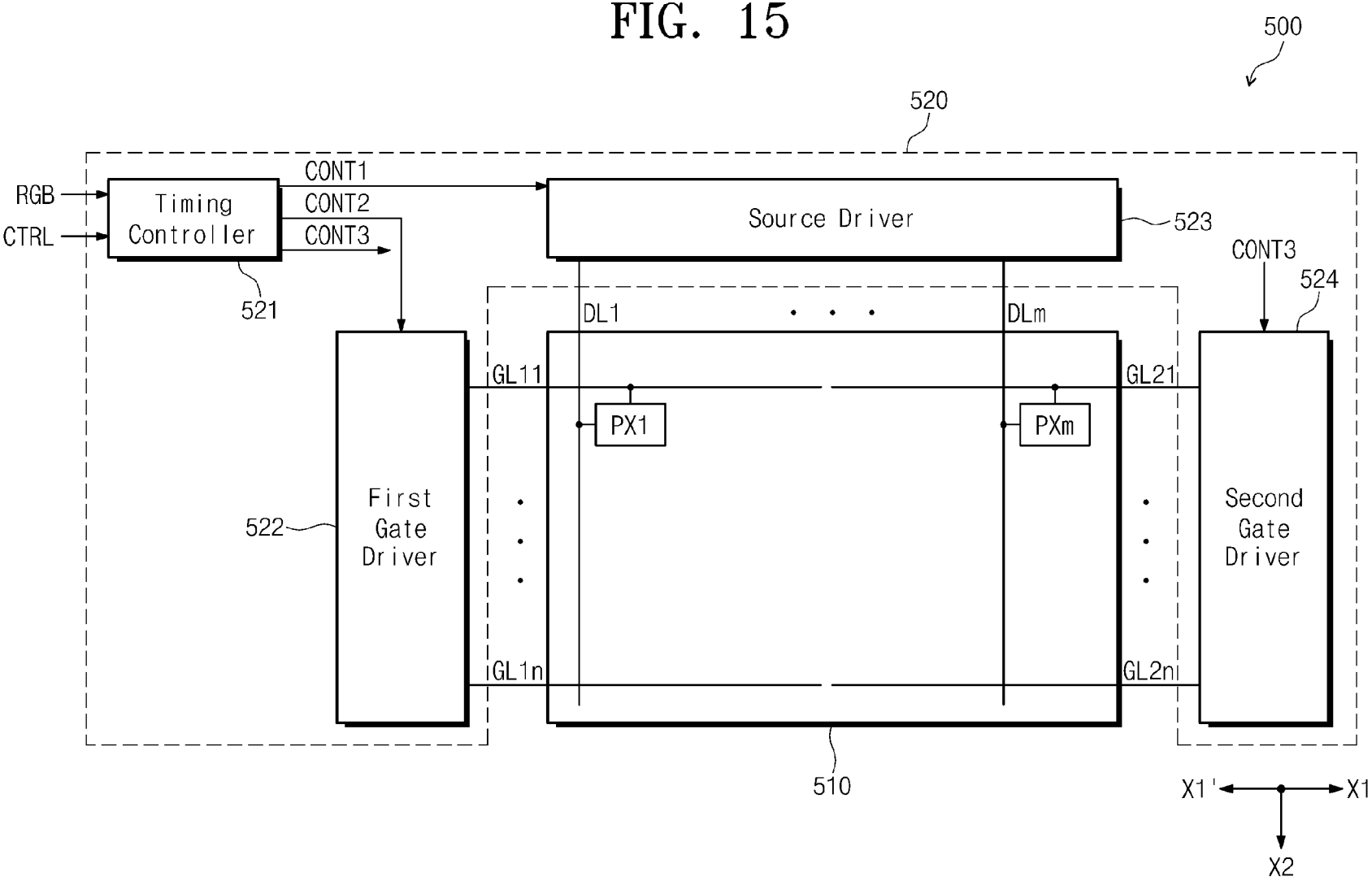
FIG. 15 is a block diagram illustrating another exemplary embodiment of a configuration of a display device according to the invention.

FIG. 15 is a block diagram illustrating a configuration of a display device according to another exemplary embodiment of the invention.

Referring to FIG. 15, a display device 500 includes a display panel 510 and a driving circuit 520. The display circuit 520 includes a timing controller 521, first and second gate drivers 522 and 524, and a source driver 523. The display device 500 illustrated in FIG. 15 has a similar configuration to the display device 100 illustrated in FIG. 1 and accordingly overlapping description will be omitted. The driving circuit 520 of the display device 500 includes two gate drivers 522 and 524. The first and second gate drivers 522 and 524 are disposed at both opposite sides of the display panel 410. The timing controller 521 provides a gate control signal CONT2 to the first gate driver 522 and a gate control signal CONT3 to the second gate driver 524.

Figure 16:
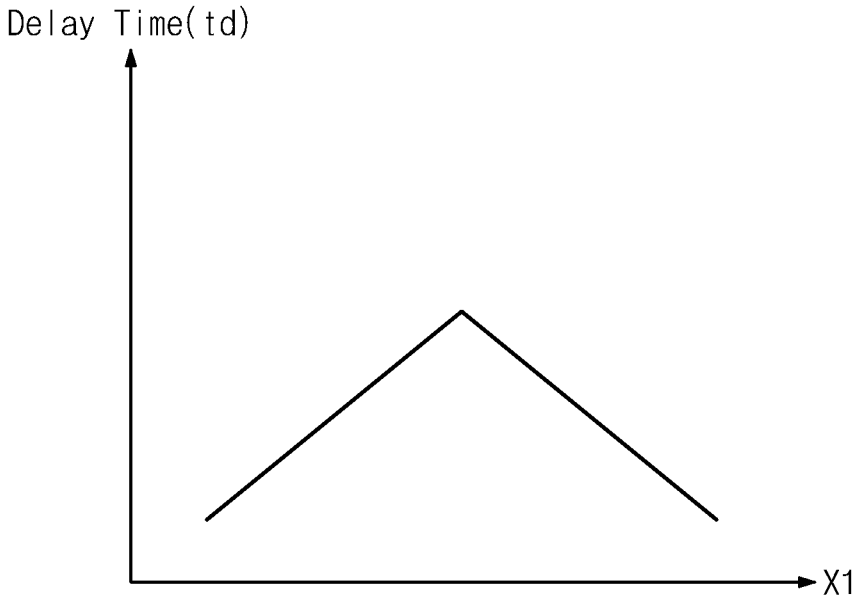
FIG. 16 is a graph exemplarily illustrating a delay time of a data driving signal according to positions of data lines illustrated in FIG. 15.

FIG. 16 is a graph exemplarily illustrating a delay time of a data driving signal according to positions of data lines illustrated in FIG. 15.

Referring to FIGS. 15 and 16, when the first and second gate drivers 522 and 524 are disposed at both sides of the display panel 510, a delay time td of a data driving signal provided to a data line becomes longer as the data line is farther from the first and second gate drivers 522 and 524, namely, as the data line is closer to the center of the display panel 510.

In such a way, display quality of the display device 500 can be improved by adjusting an output timing of the data driving signal according to a distance between the gate driver and the data line.

A display device including a driving circuit having the above-described configuration may control output timings of data driving signals according to a distance between a gate driver and data lines. Accordingly, display quality of the display device can be improved.

The above-disclosed subject matter is to be considered illustrative and not restrictive, and the appended claims are intended to cover all such modifications, enhancements, and other exemplary embodiments, which fall within the true spirit and scope of the invention. Thus, to the maximum extent allowed by law, the scope of the invention is to be determined by the broadest permissible interpretation of the following claims and their equivalents, and shall not be restricted or limited by the foregoing detailed description.

What is claimed is:

1. A driving circuit comprising:

a receiver which receives an image control signal comprising a data signal and a clock signal, separates the data signal from the clock signal, and outputs the data and clock signals separated from each other;

a clock recovery unit which generates a reference clock signal based on the clock signal and generates a plurality of multi-phase clock signals having different phases from that of the reference clock signal;

an output clock generation unit which outputs a plurality of output clock signals in synchronization with the clock signal and the plurality of multi-phase clock signals; and a data output unit which drives a plurality of data lines with a data driving signal corresponding to the data signal in synchronization with the output clock signal, wherein the plurality of data lines is sequentially arrayed in a first direction, the clock recovery unit outputs the plurality of multi-phase clock signals and adjusts output timing of the data driving signal according to positions of the plurality of data lines in the first direction, the plurality of output clock signals respectively has different phases from each other, the data output unit comprises a plurality of buffer groups respectively comprising a plurality of buffer, and buffers belonging to one buffer group provide the data driving signal to the corresponding data line in synchronization with a corresponding an identical output clock signal among the plurality of output clock signals.

2. The driving circuit of claim 1, wherein the output clock generation unit comprises a plurality of flip-flop arrays which respectively receives the clock signal and corresponds to each of the plurality of multi-phase clock signals, and each of the plurality of flip-flop arrays comprises a plurality of flip-flops sequentially connected to each other in serial, and each of the flip-flops outputs an output clock signal in synchronization with a corresponding multi-phase clock signal among the plurality of multi-phase clock signals.

3. The driving circuit of claim 2, wherein the clock recovery unit further generates a horizontal start signal, and a horizontal clock signal based on the clock signal.

4. The driving circuit of claim 3, wherein the receiver further outputs a load signal and the data output unit further comprises a shift register which outputs a plurality of latch clock signals in synchronization with the horizontal start signal and the horizontal clock signal;

a latch unit which latches the data signal in response to the plurality of latch clock signals and outputs the latched data signal in response to the load signal; and a digital-to-analog converter which converts the latched data signal into the corresponding data driving signal.

5. The driving circuit of claim 1, wherein the clock recovery unit comprises a phase locked loop.

6. A display device comprising:

a plurality of data lines extended in a first direction;

a plurality of gate lines extended in a second direction;

a plurality of pixels respectively connected to the plurality of gate lines and the plurality of data lines;

a gate driver which drives the plurality of gate lines;

a source driver which drives the plurality of data lines in response to an image control signal; and a timing controller which provides the image control signal comprising a data signal and a clock signal to the source driver and control the gate driver, wherein the source driver comprises:

a receiver which receives the image control signal comprising the data signal and the clock signal, separates the data signal from the clock signal and outputs the data and clock signals separated from each other;

a clock recovery unit which generates a reference clock signal based on the clock signal and generates a plurality of multi-phase clock signals having different phases from the reference clock signal;

an output clock generation unit which outputs a plurality of output clocks signal in synchronization with the clock signal and the plurality of multi-phase clock signals; and a data output unit which drives the plurality of data lines with a data driving signal corresponding to the data signal in synchronization with the output clock signal, wherein the clock recovery unit outputs the plurality of multi-phase clock signals and adjusts output timing of the data driving signal according to positions of the plurality of data lines in the first direction, the plurality of output clock signals respectively has different phases from each other, the data output unit comprises a plurality of buffer groups respectively comprising a plurality of buffer, and buffers belonging to one buffer group provide the data driving signal to the corresponding data line in synchronization with a corresponding an identical output clock signal among the plurality of output clock signals.

7. The display device of claim 6, wherein the output clock generation unit comprises a plurality of flip-flop arrays which respectively receives the clock signal and corresponds to the plurality of multi-phase clock signals, and each of the plurality of flip-fop arrays comprises a plurality of flip-flops sequentially connected to each other in series, and each of the plurality of flip-flops outputs an output clock signal in synchronization with a corresponding multi-phase clock signal among the plurality of multi-phase clock signals.

8. The display device of claim 7, wherein the clock recovery unit further generates a horizontal start signal, and a horizontal clock signal based on the clock signal.

9. The display device of claim 8, wherein the data output unit further comprises a shift register which outputs a plurality of latch clock signals in synchronization with the clock signal and the horizontal clock signal;

a latch unit which latches the data signal in response to the plurality of latch clock signals and outputs the latched data signal in response to a load signal received from the receiver; and a digital-to-analog converter which converts the latched data signal into the corresponding data driving signal.

10. The display device of claim 6, wherein the clock recovery unit comprises a phase locked loop.

* * * * *